US006055708A

United States Patent [19]

Ellis et al.

[11] Patent Number: 6,055,708

[45] Date of Patent: May 2, 2000

[54] SEAT BELT BUCKLE WITH A SHIELD BLOCKING A TONGUE RECEIVING OPENING

[75] Inventors: Robert P. Ellis, Almont; Duan W. Chisnell, Dryden, both of Mich.

[73] Assignee: TRW Vehicle Safety Systems Inc., Lyndhurst, Ohio

[21] Appl. No.: 09/371,650

[22] Filed: Aug. 10, 1999

[51] Int. Cl.[7] ..... A44B 11/26

[52] U.S. Cl. ..... 24/642; 24/641; 24/636; 24/637

[58] Field of Search ..... 24/641, 642, 643, 24/640, 633, 631, 636, 639, 637, 645

[56] References Cited

U.S. PATENT DOCUMENTS

| | | | |
|---|---|---|---|
| 4,065,836 | 1/1978 | Stephenson . | |
| 4,069,557 | 1/1978 | Loomba . | |
| 4,380,100 | 4/1983 | Crisp | 24/642 |
| 4,388,746 | 6/1983 | Krautz et al. . | |
| 4,527,317 | 7/1985 | Straszewski et al. | 24/641 |
| 4,542,563 | 9/1985 | Befort | 24/641 |
| 4,870,726 | 10/1989 | Eksell et al. | 24/636 |

*Primary Examiner*—James R. Brittain
*Assistant Examiner*—Robert J. Sandy
*Attorney, Agent, or Firm*—Tarolli, Sundheim, Covell, Tummino & Szabo L.L.P.

[57] ABSTRACT

A seat belt buckle (12) includes a buckle base (34) having a passage (36) for receiving a tongue (16) by movement of the tongue in a first direction into the passage. An ejector (40) in the passage (36) is biased in a second direction opposite the first direction. The ejector (40) moves in the first direction against the bias upon insertion of the tongue (16) into the passage (36). A latch (42) latches the tongue (16) in the passage (36). The buckle (12) includes structure (24, 32) defining an opening (22) through which the tongue (16) is inserted into the passage (36). A shield (60) blocks the opening (22) and blocks foreign matter from passing through the opening.

9 Claims, 4 Drawing Sheets

SEAT BELT BUCKLE WITH A SHIELD BLOCKING A TONGUE RECEIVING OPENING

FIELD OF THE INVENTION

The present invention relates to a seat belt buckle.

BACKGROUND OF THE INVENTION

A seat belt system for restraining a vehicle occupant typically includes seat belt webbing, a seat belt locking tongue on the webbing, and a seat belt buckle. The tongue on the webbing is inserted through an opening in the buckle when the webbing has been placed about a vehicle occupant. A latch mechanism in the buckle interlocks with the tongue to secure the webbing about the occupant. When the tongue is not inserted into the buckle, foreign matter may pass through the opening into the buckle.

SUMMARY OF THE INVENTION

In accordance with the present invention, a seat belt buckle includes a buckle base having a passage for receiving a tongue by movement of the tongue in a first direction into the passage. An ejector in the passage is biased in a second direction opposite the first direction. The ejector moves in the first direction against the bias upon insertion of the tongue into the passage. A latch latches the tongue in the passage. The buckle includes structure defining an opening through which the tongue is inserted into the passage. A shield blocks the opening and blocks foreign matter from passing through the opening.

BRIEF DESCRIPTION OF THE DRAWINGS

The foregoing and other features of the present invention will become apparent to one skilled in the art to which the present invention relates upon reading the following description of the invention with reference to the accompanying drawings, wherein.

DESCRIPTION OF PREFERRED THE EMBODIMENT

Figure 1:
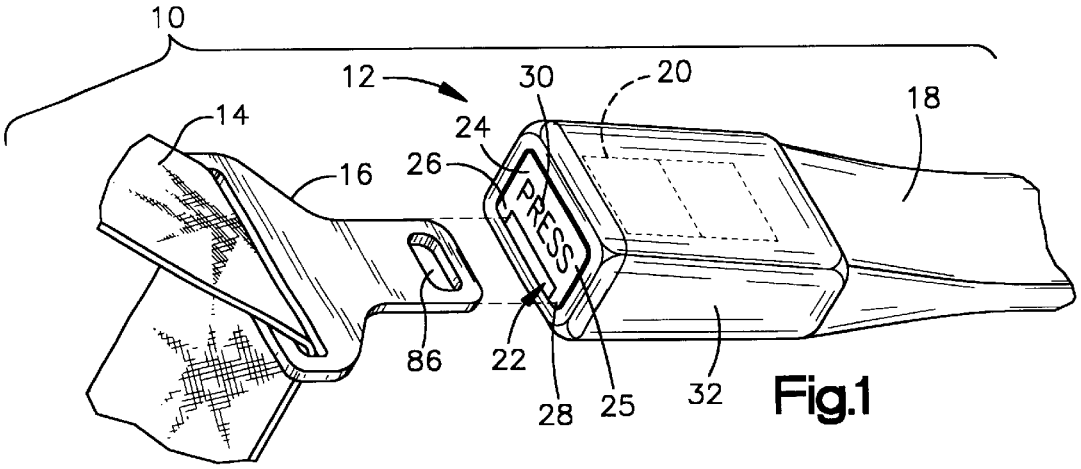
FIG. 1 is an isometric view of a vehicle occupant restraint apparatus including a seat belt buckle in accordance with the present invention.

A vehicle occupant restraint apparatus 10 (FIG. 1) includes a seat belt buckle 12, seat belt webbing 14, and a seat belt tongue 16 on the webbing 14. The buckle 12 is anchored in a vehicle in a known manner, such as by a cable or anchor strap (not shown) extending within a cover 18. A latch mechanism 20 (shown schematically in FIG. 1) locks the tongue 16 in the buckle 12 when the tongue 16 is moved into a rectangular opening 22 (FIG. 1) at the end of the buckle 12. The tongue 16 is subsequently released from the buckle 12 upon depression of a pushbutton 24 adjacent to and partially defining the opening 22.

The pushbutton 24 (FIG. 1) has a U-shaped portion 25. The U-shaped portion 25 includes portions 26 and 28 extending from a main portion 30. The portions 26, 28, and 30 of the pushbutton 24 define three sides of the opening 22. The fourth or bottom side of the opening 22 is defined by a housing or body portion 32 of the buckle 12.

The buckle 12 (FIG. 2) includes a base 34 supporting the latch mechanism 20 within the housing 32. The base 34 defines a passage 36 which receives the tongue 16. The tongue 16 is inserted through the opening 22 and into the passage 36 in a first direction, toward the right as viewed in FIG. 2.

The latch mechanism 20 may comprise any suitable structure capable of releasably interlocking with the tongue 16 in cooperation with the pushbutton 24. As shown by way of example, the latch mechanism 20 includes the pushbutton 24, an ejector 40, and a latch 42. The latch 42 is movable between a non-locking position, shown in FIG. 2, and a locking position, shown in FIG. 4. A latch spring 44 engages an upper portion 48 of the latch 42 to bias the latch toward the locking position.

Figure 3:
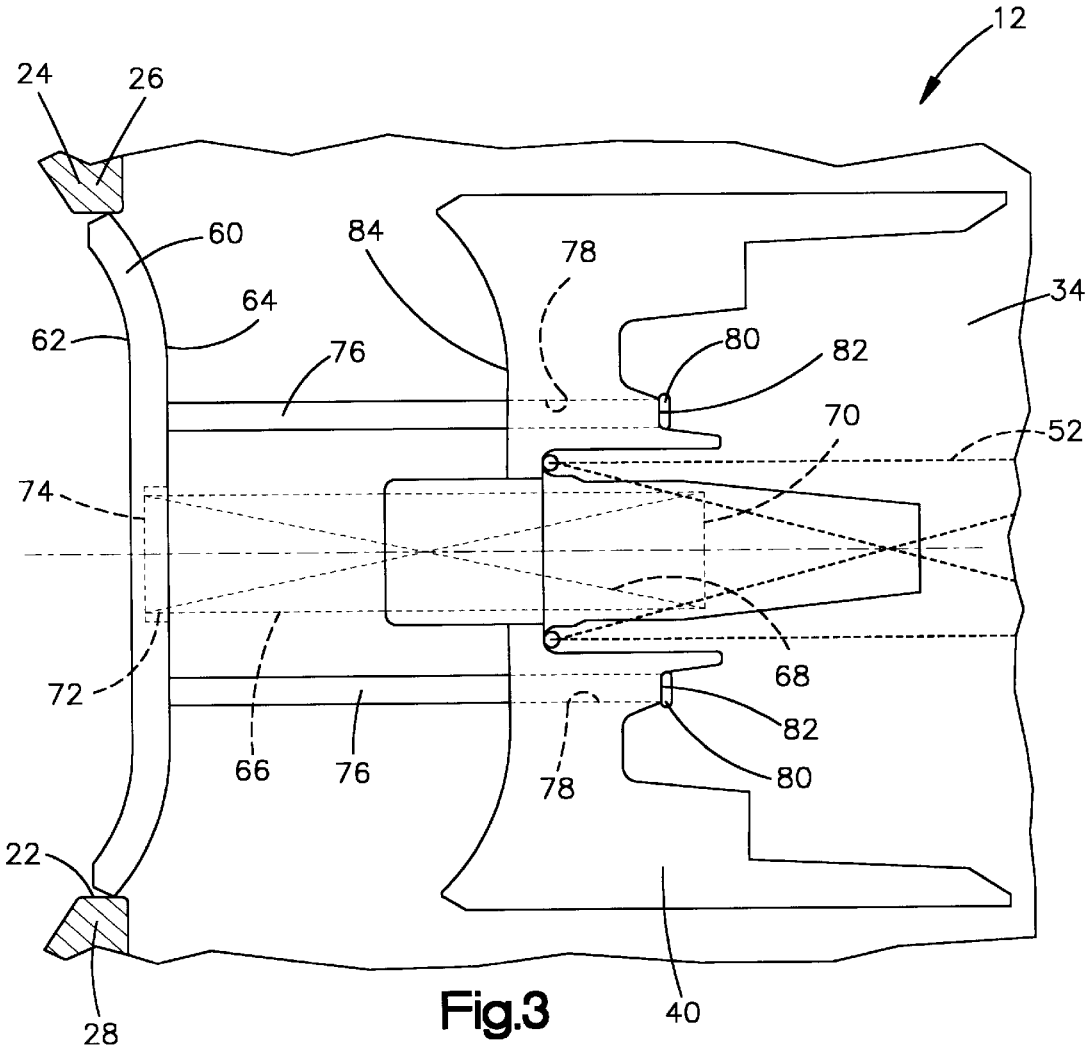
FIG. 3 is a view taken along the line 3—3 of FIG. 2.
Figure 2:
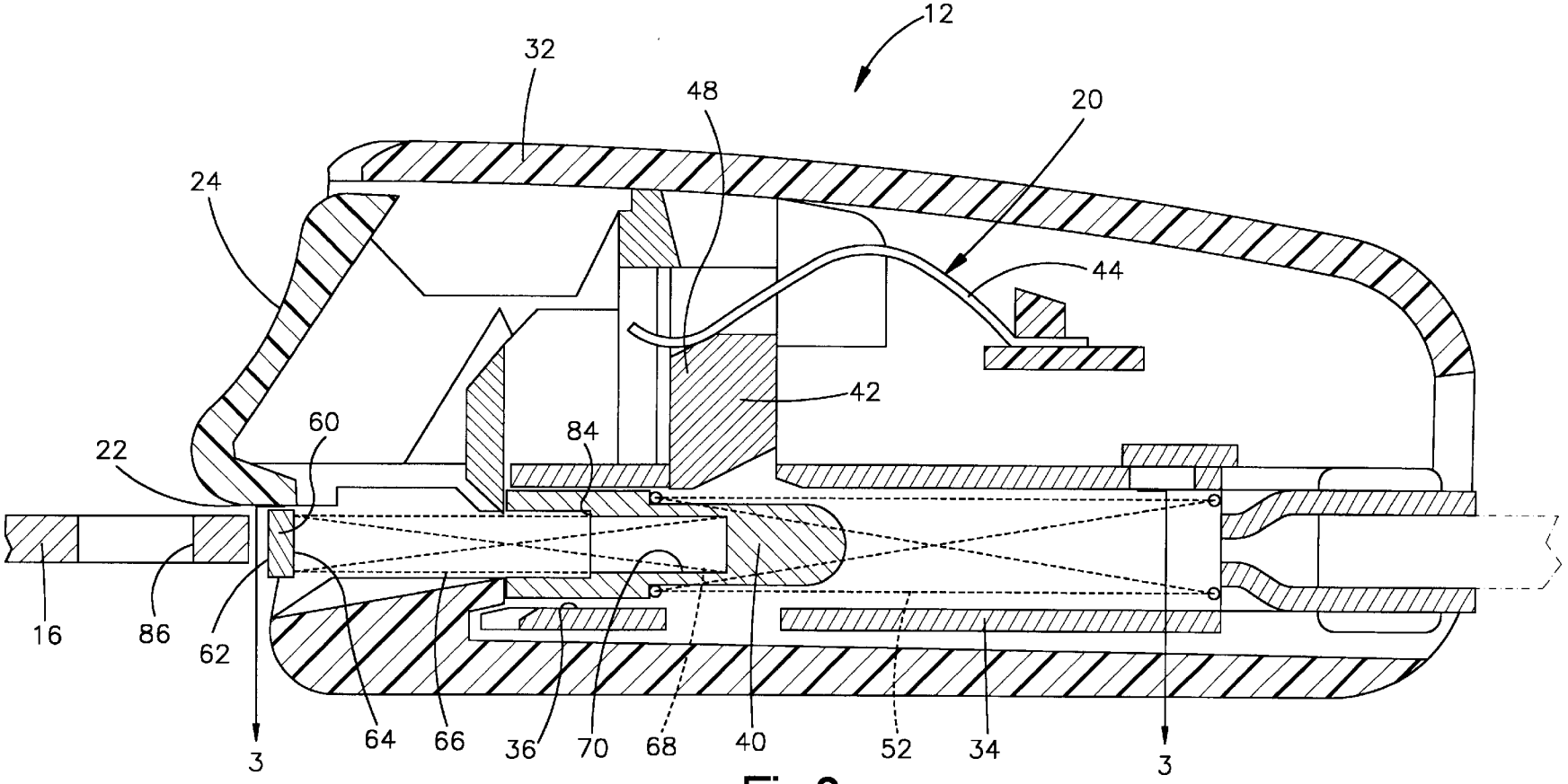
FIG. 2 is a side view, partly in section, of parts of the apparatus of FIG. 1, with certain parts being shown schematically.

The ejector 40 is located within the passage 36 and has a first position, shown in FIGS. 2 and 3, in which the ejector holds the latch 42 in the non-locking position against the bias of the latch spring 44. The ejector 40 has a second position shown in FIGS. 4 and 5, when the tongue 16 is latched in the passage 36. An ejector spring 52 biases the ejector 40 in a second direction, toward the left as viewed in FIG. 2, opposite the first direction. The ejector spring 52 biases the ejector 40 to the first position and against a stop (not shown).

A shield 60 has a first position, shown in FIGS. 2 and 3, blocking the opening 22 and blocking foreign matter from passing through the opening. The shield 60 has a second position, shown in FIGS. 4 and 5, when the tongue 16 is latched in the passage 36. The shield 60 has an outer surface 62 engageable by the tongue 16 when the tongue is to be inserted through the opening 22. The shield 60 has an inner surface 64 facing toward the ejector 40.

A coil shield spring 66 biases the shield 60 in the second direction to the first position shown in FIGS. 2 and 3. The shield spring 66 (FIG. 3) has a first end portion 68 located within a recess 70 in the ejector 40. The shield spring 66 has a second end portion 72 located within a recess 74 in the shield 60. The ejector spring 52 is stronger than the shield spring 66.

The shield 60 (FIG. 3) includes pins 76 that extend from the inner surface 64 toward the ejector 40. The pins 76 extend through guides or openings 78 in the ejector 40. Flanges 80 on the distal ends of the pins 76 engage shoulders 82 on the ejector 40 to prevent the pins from being pulled out of the openings 78.

When the tongue 16 is to be inserted through the opening 22, it is first moved into engagement with the outer surface 62 of the shield 60. The tongue 16 is then moved further in the first direction against the shield 60 so as to push the shield 60 along the passage 36 from the first position toward the ejector 40 against the bias of the shield spring 66. When the inner surface 64 of the shield 60 engages a surface 84 of the ejector 40, further inward movement of the tongue 16 pushes the shield 60 and the ejector 40 along the passage 36 against the bias of the ejector spring 52 to the positions shown in FIGS. 4 and 5.

Figure 4:
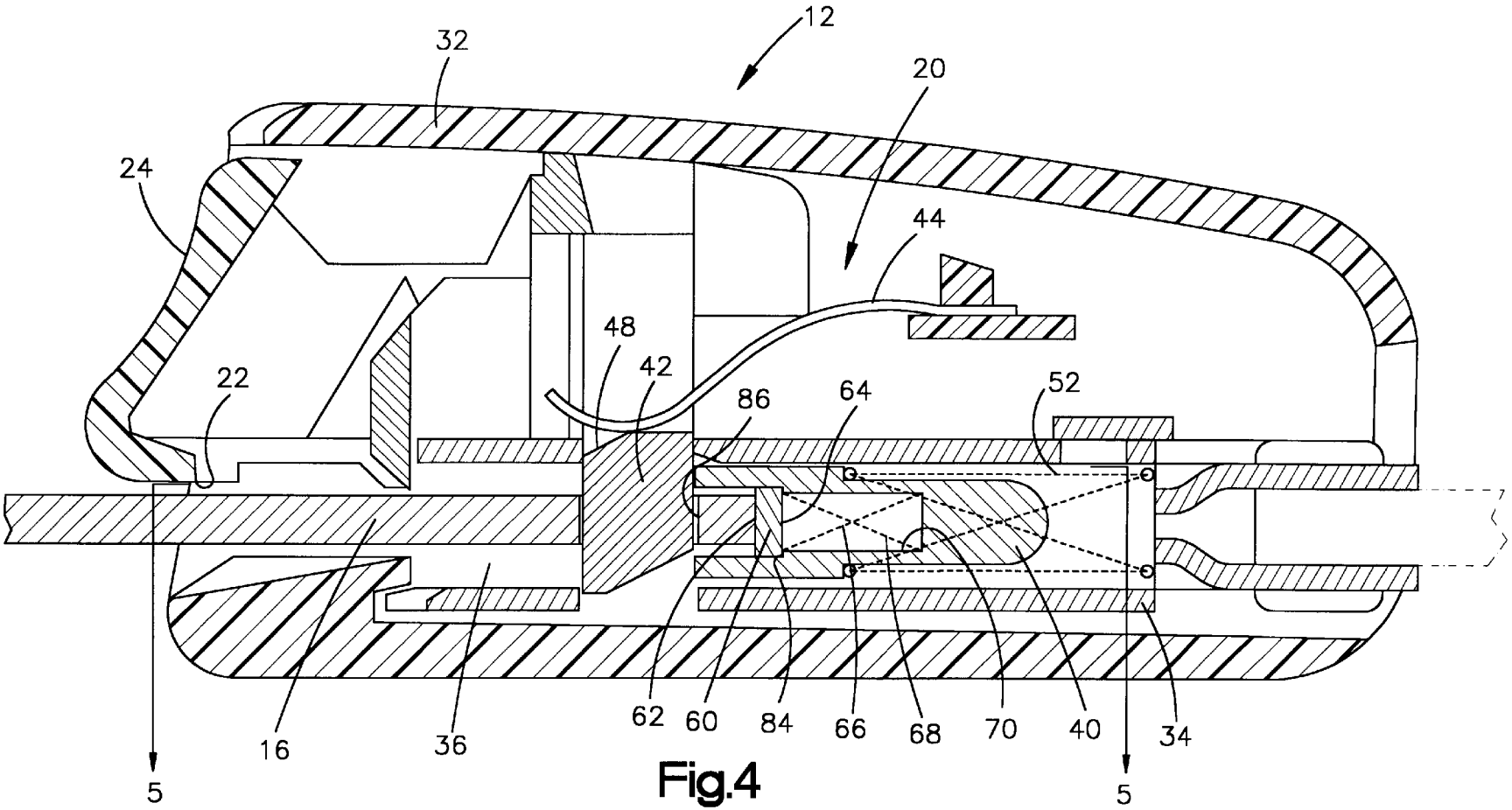
FIG. 4 is a view similar to FIG. 2 showing a tongue inserted into the buckle.
Figure 5:
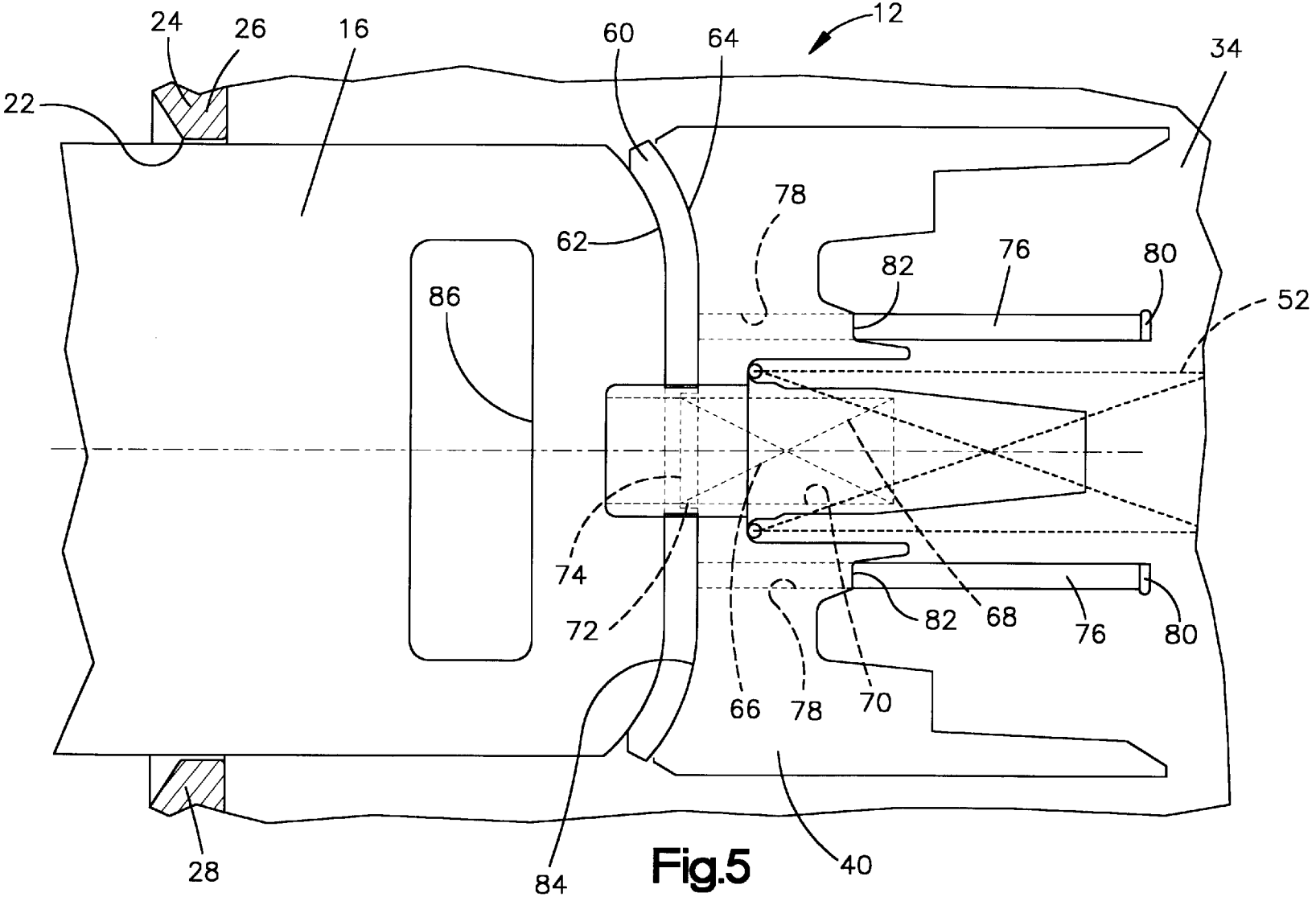
FIG. 5 is a view taken along the line 5—5 of FIG. 4.

As the tongue 16, the shield 60, and the ejector 40 approach the positions of FIGS. 4 and 5, an aperture 86 in the tongue 16 moves into alignment with the latch 42. The latch spring 44 then moves the latch 42 downward (as viewed in FIG. 2) to the locking position, shown in FIG. 4, through the aperture 86 in the tongue 16 so that the latch 42 blocks removal of the tongue 16 from the buckle 12.

When the tongue 16 is to be released from the buckle 12, the pushbutton 24 is moved against the bias of a pushbutton spring (not shown). The pushbutton 24 engages, or may be linked with, the latch 42 in a known manner so as to move the latch out of the aperture 86 in the tongue 16 against the bias of the latch spring 44. The ejector spring 52 then moves the ejector 40, the shield 60, and the tongue 16 in the second direction along the passage 36 toward the opening 22 to eject the tongue from the buckle 12. When the ejector 40 reaches the position shown in FIG. 2, the shield spring 66 moves the shield 60 away from the ejector. The spring 66 moves the shield 60 until the flanges 80 on pins 76 engage the shoulders 82 on the ejector 40. The shield 60 is located in the position shown in FIG. 2 blocking the opening 22.

From the above description of the invention, those skilled in the art will perceive improvements, changes and modifications. Such improvements, changes and modifications within the skill of the art are intended to be covered by the appended claims.

Having described the invention, the following is claimed:

1. A seat belt buckle for receiving a tongue, said seat belt buckle comprising:

a buckle base having a passage for receiving a tongue by movement of the tongue in a first direction into said passage;

an ejector in said passage, said ejector being biased in a second direction opposite said first direction and moving in said first direction against said bias upon insertion of said tongue into said passage;

a latch for latching said tongue in said passage;

structure defining an opening through which said tongue is inserted into said passage; and a shield having a first position blocking said opening and blocking foreign matter from passing through said opening said shield being movable relative to said ejector.

2. A seat belt buckle as defined in claim 1 wherein said shield is movable in said first direction from said first position to a second position when said tongue is inserted through said opening and into said passage.

3. A seat belt buckle as defined in claim 2 further including a spring biasing said shield to said first position, said spring acting between said ejector and said shield.

4. A seat belt buckle as defined in claim 3 wherein said spring is a coil spring and has one end portion located in a first recess in said shield and an opposite end portion located in a second recess in said ejector.

5. A seat belt buckle as defined in claim 2 wherein said shield has pins extending therefrom and movable with said shield, said ejector having guides which receive said pins and guide movement of said shield to said second position.

6. A seat belt buckle as defined in claim 2 wherein said shield has an outer surface which is engaged by said tongue when said tongue is inserted through said opening and an inner surface which engages said ejector and causes movement of said ejector in said first direction as said tongue moves in said first direction in said passage.

7. A seat belt buckle as defined in claim 6 further including a first spring biasing said shield in said second direction opposite said first direction, said first spring acting between said ejector and said shield, and a second spring biasing said ejector in said second direction, said second spring being stronger than said first spring.

8. A seat belt buckle as defined in claim 1 further including a pushbutton movable to move said latch to release said tongue and wherein said structure comprises a buckle body portion and a portion of said pushbutton.

9. A seat belt buckle as defined in claim 8 wherein said portion of said pushbutton comprises a U-shaped portion, three sides of said opening being defined by said U-shaped portion and one side of said opening being defined by said buckle body portion.

* * * * *